US009159269B2

(12) United States Patent
Yata et al.

(10) Patent No.: US 9,159,269 B2
(45) Date of Patent: Oct. 13, 2015

(54) DISPLAY DEVICE AND ILLUMINATION UNIT

(75) Inventors: Tatsuya Yata, Gifu (JP); Yoshihiro Watanabe, Kanagawa (JP)

(73) Assignee: Japan Display Inc., Tokyo (JP)

( * ) Notice: Subject to any disclaimer, the term of this patent is extended or adjusted under 35 U.S.C. 154(b) by 764 days.

(21) Appl. No.: 13/402,224

(22) Filed: Feb. 22, 2012

(65) Prior Publication Data

US 2012/0242232 A1 Sep. 27, 2012

(30) Foreign Application Priority Data

Mar. 25, 2011 (JP) ..... 2011-067656

(51) Int. Cl.
*H05B 41/16* (2006.01)
*G09G 3/34* (2006.01)

(52) U.S. Cl.
CPC ..... *G09G 3/3406* (2013.01); *G09G 3/3426* (2013.01); *G09G 2300/0456* (2013.01); *G09G 2360/144* (2013.01)

(58) Field of Classification Search
None
See application file for complete search history.

(56) References Cited

U.S. PATENT DOCUMENTS

2007/0257928 A1* 11/2007 Marks et al. ..... 345/581
2010/0110682 A1* 5/2010 Jung et al. ..... 362/249.02

FOREIGN PATENT DOCUMENTS

| | | |
|---|---|---|
| JP | 06-027440 | 2/1994 |
| JP | 11-295692 | 10/1999 |
| JP | 2004-096593 | 3/2004 |
| JP | 2008-107580 | 5/2008 |

OTHER PUBLICATIONS

Japanese Office Action issued Sep. 24, 2014 in corresponding Japanese Application No. 2011-067656.
Decision of Refusal issued Jul. 7, 2015 in corresponding Japanese Application No. 2011-067656.
Decision for Dismissal of Amendment issued Jul. 7, 2015 in corresponding Japanese Application No. 2011-067656.

* cited by examiner

*Primary Examiner* — Cassandra Cox
(74) *Attorney, Agent, or Firm* — K&L Gates LLP

(57) ABSTRACT

A display device includes: a reflective image display unit having a display region provided with an array of pixels; an illumination unit that illuminates the display region of the image display unit; and a light control unit that controls the intensity of the illumination light from the illumination unit according to ambient illuminance.

4 Claims, 7 Drawing Sheets

221a
221b
221c
221d
221
220
EXTERNAL LIGHT
31
S1
30
S2
LIGHT SOURCE DRIVING CIRCUIT
223
LIGHT CONTROL CIRCUIT
32
DISPLAY PANEL DRIVING CIRCUIT
14
DISPLAY PANEL DRIVING SIGNAL
Y
X
Z
2
10
11
12
13

DISPLAY DEVICE AND ILLUMINATION UNIT

CROSS REFERENCES TO RELATED APPLICATIONS

The present application claims priority to Japanese Priority Patent Application JP 2011-067656 filed in the Japan Patent Office on Mar. 25, 2011, the entire content of which is hereby incorporated by reference.

BACKGROUND

The present disclose relates to display devices, and to illumination units.

Display devices are known that include a transmissive image display unit by which the transmittance of the incident light falling on the back side is controlled for image display. Display devices including a reflective image display unit that controls the reflectance of external light for image display are also known. A transmissive liquid crystal display panel is an example of such a transmissive image display unit. Examples of the reflective image display unit include a reflective liquid crystal display panel and electronic paper.

The reflective liquid crystal display panel includes a reflecting film that reflects external light, and displays an image by controlling the reflectance of external light with a liquid crystal layer. The electronic paper displays an image by varying the surface reflectance, which is achieved by, for example, moving the white and black pigments according to image patterns. Display devices provided with a reflective image display unit can use external light for image display. The display device with a reflective image display unit can thus realize low power consumption, thinness, and lightness, and have use as, for example, a portable device.

Display devices provided with a transmissive image display unit typically includes a backlight that shines light on the back side of the image display unit. The display device with a transmissive image display unit can control and provide image visibility by increasing the intensity of the backlight in high ambient illuminance, and decreasing the intensity of the backlight in low ambient illuminance. For example, JP-A-6-27440 describes a display device that controls the backlight luminance, which is raised to a reference luminance under bright external light illuminance conditions, and lowered under dark external light illuminance conditions.

In the display device with a reflective image display unit, desirable images can be recognized, for example, when the ambient illuminance can sufficiently provide photopic vision. However, image visibility suffers when the ambient illuminance can only provide mesopic vision or scotopic vision. As a countermeasure, a display device is proposed that includes an illumination unit that shines light on the front side of the reflective image display unit to increase the image luminance and improve visibility in a low illuminance environment.

SUMMARY

As described above, the display device with a transmissive image display unit controls the backlight intensity, which is increased to increase the image luminance under high ambient illuminance conditions, and is decreased under low ambient illuminance conditions. In this way, images can be viewed in a desirable luminance according to the ambient illuminance. However, this is problematic when performed on the illumination unit of the display device provided with a reflective image display unit. Specifically, for example, shining light from the illumination unit under sufficiently high ambient illuminance conditions does not greatly improve image visibility but wastes power. On the other hand, shining strong light from the illumination unit under low ambient illuminance conditions overly increases the image luminance, and creates fatigue on the viewer.

Accordingly, there is a need for a display device that includes a reflective image display unit, capable of producing an image of a desirable luminance according to the ambient illuminance while suppressing power consumption. There is also a need for an illumination unit that illuminates the reflective image display unit.

An embodiment of the present disclosure is directed to a display device that includes:

a reflective image display unit having a display region provided with an array of pixels;

an illumination unit that illuminates the display region of the image display unit; and a light control unit that controls the intensity of the illumination light from the illumination unit according to ambient illuminance.

Another embodiment of the present disclosure is directed to an illumination unit that illuminates a reflective image display unit that has a display region provided with an array of pixels, the illumination unit including a light control unit that controls the intensity of the illumination light on the display region of the image display unit according to ambient illuminance.

Still another embodiment of the present disclosure is directed to a display device that includes:

a reflective image display unit having a display region provided with an array of pixels; and a light control unit that controls the operation of an illumination unit that illuminates the display region of the image display unit, the light control unit controlling the operation of the illumination unit according to ambient illuminance.

The display device according to the embodiment of the present disclosure can produce an image of a desirable luminance according to the ambient illuminance while suppressing power consumption. Further, the illumination unit according to the embodiment of the present disclosure can shine light in a desirable intensity according to the ambient illuminance.

Additional features and advantages are described herein, and will be apparent from the following Detailed Description and the figures.

DETAILED DESCRIPTION

Figure 1:
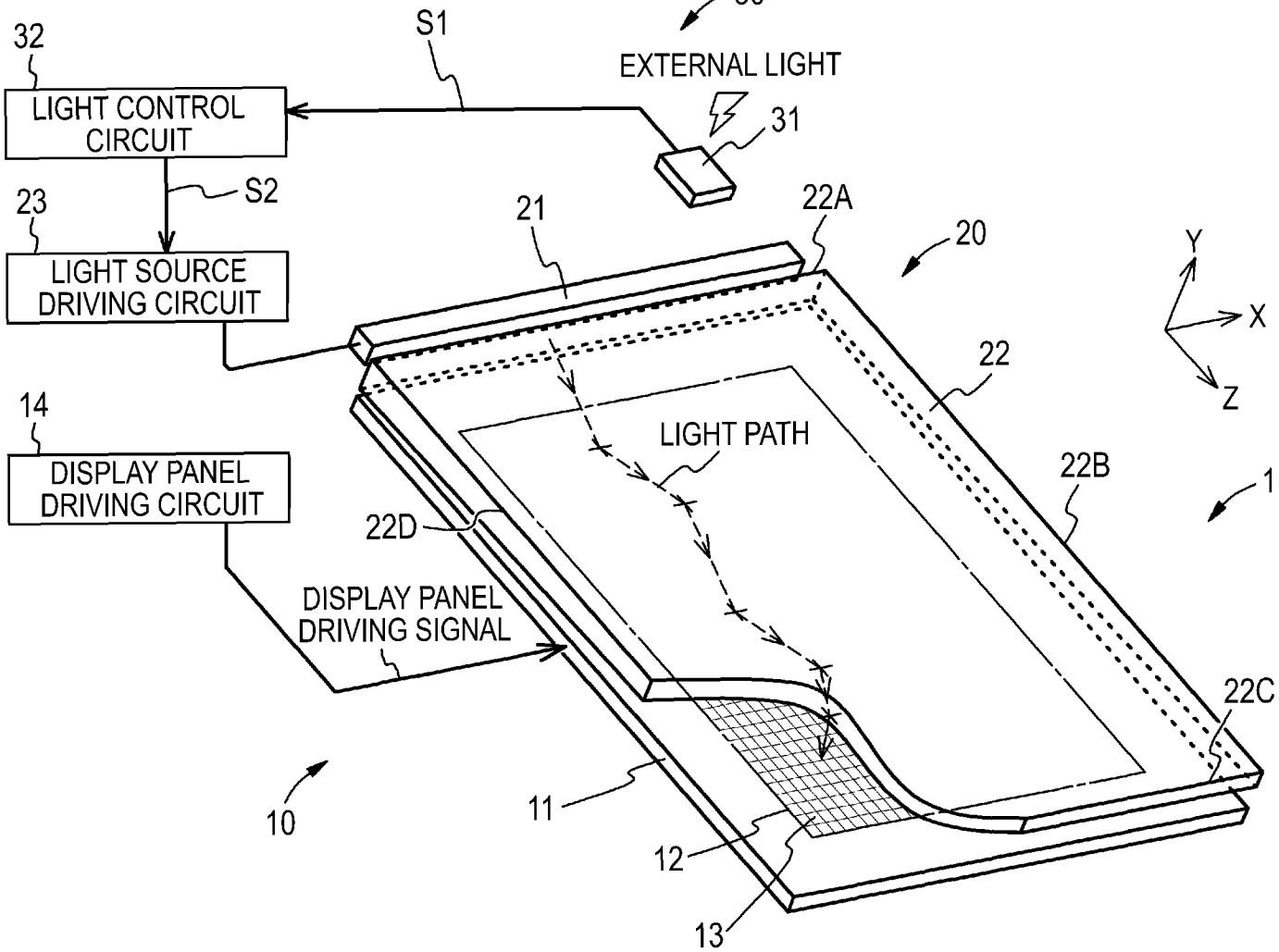
FIG. 1 is a perspective view schematically illustrating a display device of First Embodiment.

The following will describe the present disclosure based on an embodiment, with reference to the accompanying drawings. It should be noted that the present disclosure is not limited to the following embodiment, and the numerical values and materials presented in the following embodiment are illustrative. In the descriptions below, the same elements or elements having the same functions are appended with the same reference numerals, and will not be described twice. Descriptions will be given in the following order.

1. Overall descriptions, including a display device and an illumination unit according to an embodiment of the present disclosure 2. First Embodiment (Other)

[Overall Descriptions, Including a Display Device and an Illumination Unit According to an Embodiment of the Present Disclosure]

A light control unit in a display device or in an illumination unit according to an embodiment of the present disclosure may be configured to increase the intensity of the illumination light from an illumination unit with increase in ambient illuminance when the ambient illuminance is no greater than a predetermined first reference value, and to decrease the intensity of the illumination light from the illumination unit with increase in ambient illuminance when the ambient illuminance is above the first reference value and no greater than a predetermined second reference value. In this case, the light control unit may be configured to stop the illumination from the illumination unit when the ambient illuminance exceeds the second reference value.

The first reference value and the second reference value may be appropriately set to preferred values according to, for example, the design of the display device or the illumination unit. For example, an image of a desired luminance can be viewed only with ambient light when the ambient illuminance is generally about $1\times10^3$ [lux (1×)], though it depends on the specifications of the reflective image display unit. Below this ambient illuminance, a difference occurs between the luminance of an image viewed only with ambient light and the image luminance perceived as desirable. The difference peaks in the ambient illuminance range of, for example, $1\times10^2$ to $6\times10^2$ [lux]. Accordingly, for example, the first reference value may be set to $1\times10^2$ to $6\times10^2$ [lux], and the second reference value to $1\times10^3$ [lux].

The light control unit may be realized by, for example, a photosensor that measures the intensity of ambient light, and a circuit, for example, such as a light control circuit that outputs a predetermined control signal after calculating an illuminance value for the illumination light from the illumination unit based on the output of the photosensor. Known sensors, such as a photodiode and a phototransistor, may be used as the photosensor. The circuit may be realized by, for example, an arithmetic circuit and a memory device (memory), and may be configured from known circuit elements.

The configuration of the reflective image display unit is not particularly limited, and, for example, known devices such as a reflective liquid crystal display panel and electronic paper may be used. In the embodiment below, a reflective liquid crystal display panel is used as the image display unit. The liquid crystal display panel may be a monochromatic display or a color display.

The reflective liquid crystal display panel includes, for example, a front panel provided with a transparent common electrode, a rear panel provided with a pixel electrode, and a liquid crystal material disposed between the front panel and the rear panel. The reflective liquid crystal display panel may be configured to reflect light at the pixel electrode, or at a reflecting film using the transparent pixel electrode and the reflecting film in combination. The configuration of the liquid crystal display panel is not particularly limited, and the liquid crystal display panel may be driven in a TN mode, or in a VA mode or IPS mode, as they are called.

Note that a semi-transmissive image display unit having both reflective and transmissive characteristics is available, as exemplified by a semi-transmissive liquid crystal display panel that includes both a reflective display region and a transmissive display region within a pixel. Such a semi-transmissive image display unit also may be used. Specifically, "reflective image display unit" encompasses "semi-transmissive image display unit".

The shape of the image display unit is not particularly limited, and may be a horizontally long rectangle, or a vertically long rectangle. The image display unit may have M×N pixels (M, N) at the image display resolution of, for example, (640, 480), (800, 600), or (1024, 768) for a horizontally long rectangle (M and N are switched in the case of a vertically long rectangle). However, the resolution is not limited to these.

The illumination unit may be configured to shine light from a light source via a light guide panel disposed opposite the front face of the image display unit (edge light mode), or to shine light from a light source directly on the front face of the image display unit. In the latter case, the illumination unit is generally configured to illuminate the image display unit diagonally on the front.

The light source forming the illumination unit may be, for example, a light-emitting diode (LED), a cold-cathode or hot-cathode fluorescence lamp, an electroluminescence (EL) device, or a common lamp.

Examples of the transparent materials used for the light guide panel include glass, and plastic materials (for example, PMMA, polycarbonate resin, acrylic resin, amorphous polypropylene resin, and styrene resin containing AS resin).

In the illumination unit employing the edge light mode, the light guide panel may have a wedge shape. In this way, light of uniform intensity can be shone over the whole image display unit. In the illumination unit configured to shine light from a light source directly on the front face of the image display unit, light of uniform intensity can be shone by, for example, controlling the emission intensity of each light-emitting diode provided as a light source in a substantially rectangular matrix fashion. Alternatively, a light modulator, such as a lens and a neutral density (ND) filter, may be disposed on the emission side of the light source.

Note that, for example, in order to prevent an image from being viewed from a point different from a predetermined view point, angle dependence may be provided for the diffusion characteristics of the light in the display region of the image display unit. In this case, shining light of uniform intensity over the whole screen may create non-uniform luminance over the screen. The light should thus be shone with a predetermined intensity distribution.

The circuits, including the driving circuit that drives the image display unit, and the driving circuit that drives the light source may be realized by various circuits. These may be formed using known circuit elements.

The various conditions provided herein are effective when satisfied strictly or materially. The existence of any variation that may arise from the design or manufacture is also acceptable.

[First Embodiment]

First Embodiment is concerned with a display device and an illumination unit.

FIG. 1 is a schematic perspective view of a display device of First Embodiment.

As illustrated in FIG. 1, a display device 1 includes:

a reflective image display unit 10 having a display region provided with an array of pixels;

an illumination unit 20 that illuminates the display region of the image display unit; and a light control unit 30 that controls the intensity of the illumination light from the illumination unit 20 according to ambient illuminance.

The image display unit 10 includes a reflective liquid crystal display panel 11 having a display region 12 provided with an array of pixels 13. The liquid crystal display panel 11 is driven by a display panel driving circuit 14 that operates according to external video signals. For ease of explanation, the display region 12 of the liquid crystal display panel 11 is assumed to be parallel to the X-Z plane, and have a +Y direction on the image viewing side.

The illumination unit 20 includes a light guide panel 22 disposed opposite the front face of the image display unit 10 (more specifically, opposite the front surface of the liquid crystal display panel 11); a light source 21 realized by, for example, a cold-cathode fluorescence lamp, and disposed opposite an end face of the light guide panel 22; and a light source driving circuit 23 that drives the light source 21. The light guide panel 22 is substantially rectangular in shape, and has sides 22A, 22B, 22C, and 22D on the +Y direction side. The side 22A is on the side of the light source 21, and the side 22C is opposite the side 22A. For example, the sides 22A and 22C are about 12 cm long, and the sides 22B and 22D are about 16 cm long. The liquid crystal display panel 11 is similar in shape to the light guide panel 22.

Generally, the intensity of the illumination light on the side of the liquid crystal display panel 11 tends to weaken away from the light source 21. In order to cancel out this tendency, the light guide panel 22 has a wedge shape. The light source 21 is disposed opposite the end face on the side 22A of the light guide panel 22, and the light guide panel 22 gradually becomes thinner toward the side 22C away from the side 22A. The incident angle of the incident light on the liquid crystal display panel 11 in the light guide panel 22 becomes smaller every time the light undergoes total reflection in the light guide panel 22. Because the incident angle of the light on the liquid crystal display panel 11 in the light guide panel 22 becomes smaller away from the light source 21, the outgoing light is likely to occur on the side of the liquid crystal display panel 11. This cancels out the foregoing tendency, and the liquid crystal display panel 11 can be illuminated at the constant intensity, regardless of the distance from the light source 21.

The light control unit 30 includes a photosensor 31 that detects the intensity (illuminance) of the external light (ambient light), and a light control circuit 32 that controls the illumination unit 20 based on the output of the photosensor 31. The photosensor 31 is realized by, for example, a photodiode, and varies its output (voltage) according to the intensity of the external light using the photovoltaic effect. Note that the photosensor 31 is positioned so that it can receive the external light without being affected by the illumination light from the illumination unit 20.

Briefly, the light control unit 30 operates as follows. The light control circuit 32 refers to, for example, a predetermined table, determines an ambient illuminance value that corresponds to a value of photosensor output S1, and determines the intensity of the illumination light from the illumination unit 20. A light control signal S2 is then sent to the light source driving circuit 23 to control the intensity of the illumination light from the illumination unit 20.

The operation of the light control unit 30 is described in more detail below. First, the relationship between ambient illuminance and desired image luminance is described.

Figure 2:
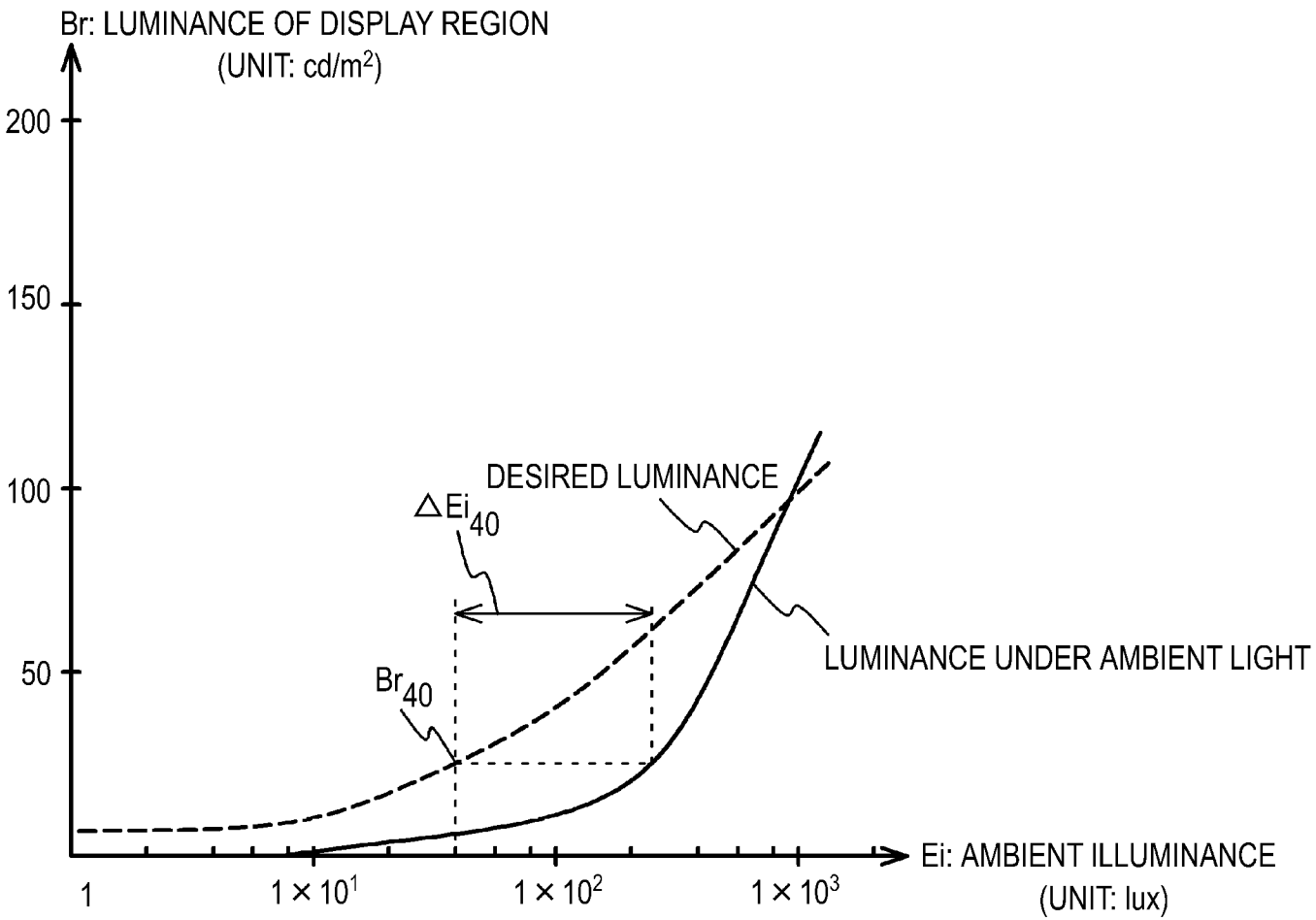
FIG. 2 is a graph explaining how ambient illuminance relates to image luminance under ambient light and to desired image luminance.

FIG. 2 is a graph explaining how ambient illuminance relates to image luminance under ambient light and to desired image luminance.

In the graph of FIG. 2, the solid line represents changes in luminance in the display region 12 under varying ambient illuminances in the all-white display state of the image display unit 10 in the absence of illumination light from the illumination unit 20. The broken line represents subject's experiment data, showing the result of plotting the luminance values perceived as desirable by a viewer viewing an image with the illumination unit 20 appropriately operated at each ambient illuminance. The horizontal axis represents ambient illuminance Ei values, and the vertical axis represents the luminance Br values of the display region 12.

As indicated by the broken line in the graph, the luminance values perceived as desirable stay below 10 [cd/m$^2$] at the ambient illuminances that provide only mesopic vision or scotopic vision (generally, ambient illuminances below 10 [lux]). Thus, in this ambient illuminance range, it is required to prevent the illumination light of the illumination unit 20 from making the image luminance excessively high.

The ambient light image luminance exceeds the desired luminance under ambient illuminances above approximately $1\times10^3$ [lux], and the illumination light from the illumination unit 20 is no longer necessary.

The illuminance value of the illumination light from the illumination unit 20 at, for example, the ambient illuminance Ei of 40 [lux] is described below with reference to FIG. 2. The desired luminance value of the display region 12 at the ambient illuminance Ei of 40 [lux] is denoted by Br40. On the solid line in the graph, the difference between the ambient illuminance value at $Br_{40}$ on the vertical axis and the ambient illuminance 40 [lux] is denoted by $\Delta Ei_{40}$.

As is clear from the graph, the luminance value of the display region 12 becomes $Br_{40}$ by shining light from the illumination unit 20 at an illuminance that makes $\Delta Ei_{40}$ at the ambient illuminance Ei of 40 [lux]. Specifically, the illuminance of the illumination light from the illumination unit 20 is $\Delta Ei_{40}$ [lux] when the ambient illuminance Ei is 40 [lux]. The illuminance values of the illumination light from the illumination unit 20 at other ambient illuminances also can be determined in the same manner.

Figure 3:
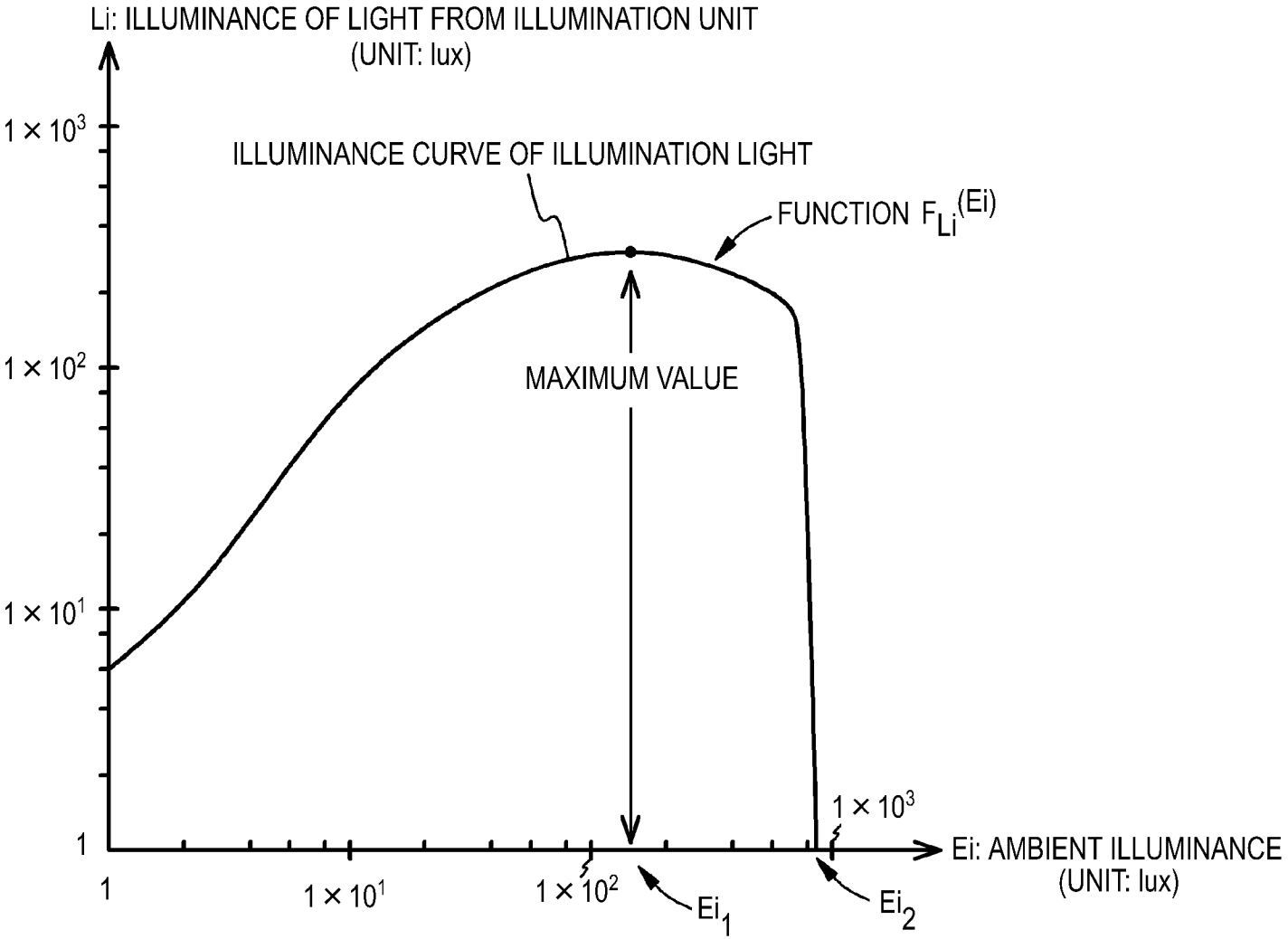
FIG. 3 is a graph schematically representing the relationship between ambient illuminance and the illuminance value of the illumination light from an illumination unit.

FIG. 3 is a graph schematically representing the relationship between ambient illuminance and the illuminance of the illumination light from the illumination unit.

In FIG. 3, the horizontal axis represents ambient illuminance Ei values, and the vertical axis represents the illuminance Li of the light from the illumination unit. As represented in FIG. 3, the illuminance curve of the illumination light from the illumination unit 20 can be represented as a function of ambient illuminance Ei. The function is given by $F_{Li}$ (Ei). As is clear from the behavior of the illuminance curve, the intensity of the illumination light from the illumination unit 20 should be increased with increase in ambient illuminance Ei when the ambient illuminance Ei is no greater than a predetermined first reference value $Ei_1$, and decreased with increase in ambient illuminance Ei when the ambient illuminance Ei is above the first reference value $Ei_1$ and no greater than a predetermined second reference value $Ei_2$. It can also be seen that the illumination from the illumination unit 20 should be stopped when the ambient illuminance Ei is above the second reference value $Ei_2$.

The operation of the light control unit 30 is described below with reference to FIGS. 4 and 5.

Figure 4:
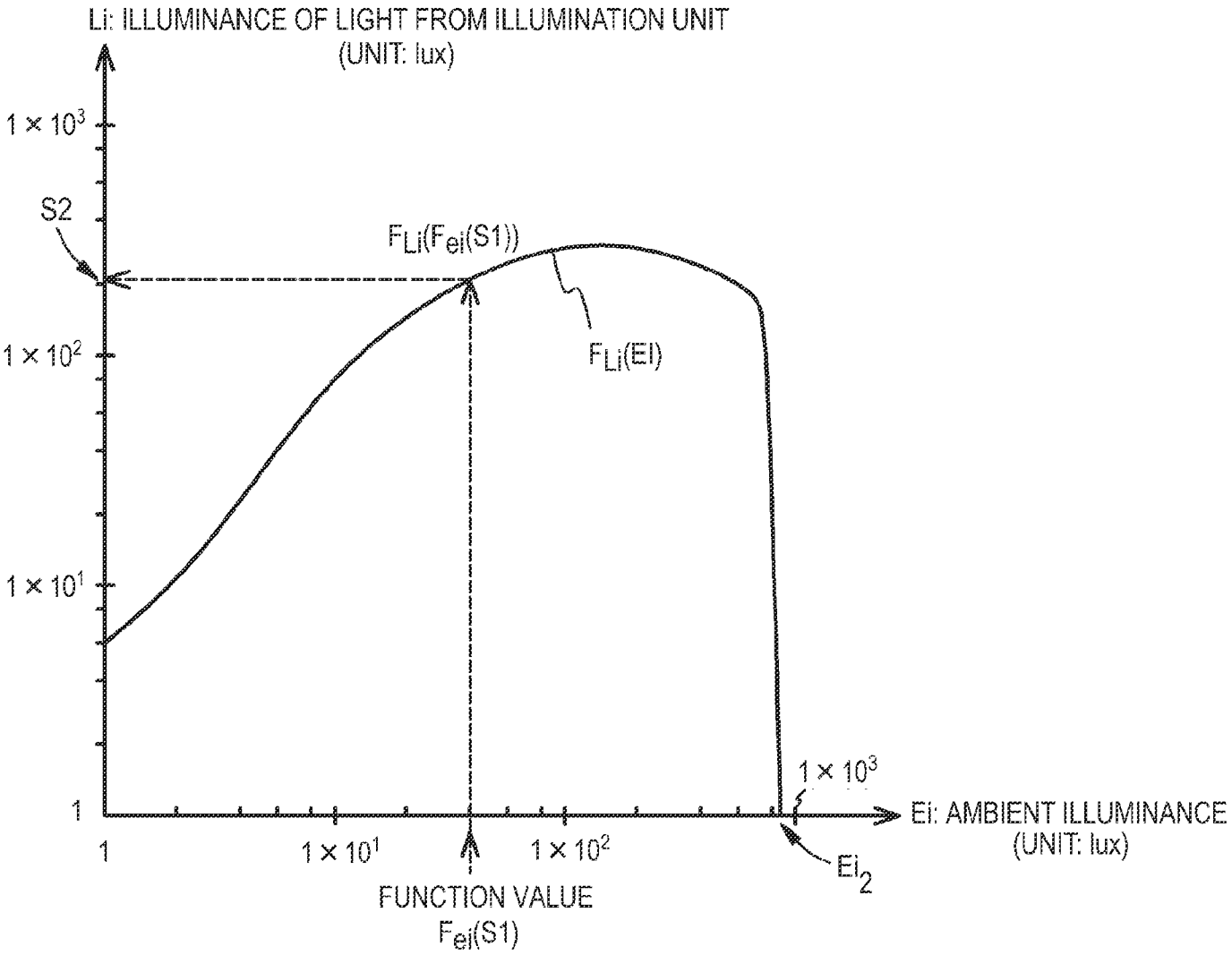
FIG. 4 is a graph schematically representing a method for determining the illuminance value of the illumination light from an illumination unit.

FIG. 4 is a graph schematically representing a method for determining the illuminance value of the illumination light from the illumination unit.

Figure 5:
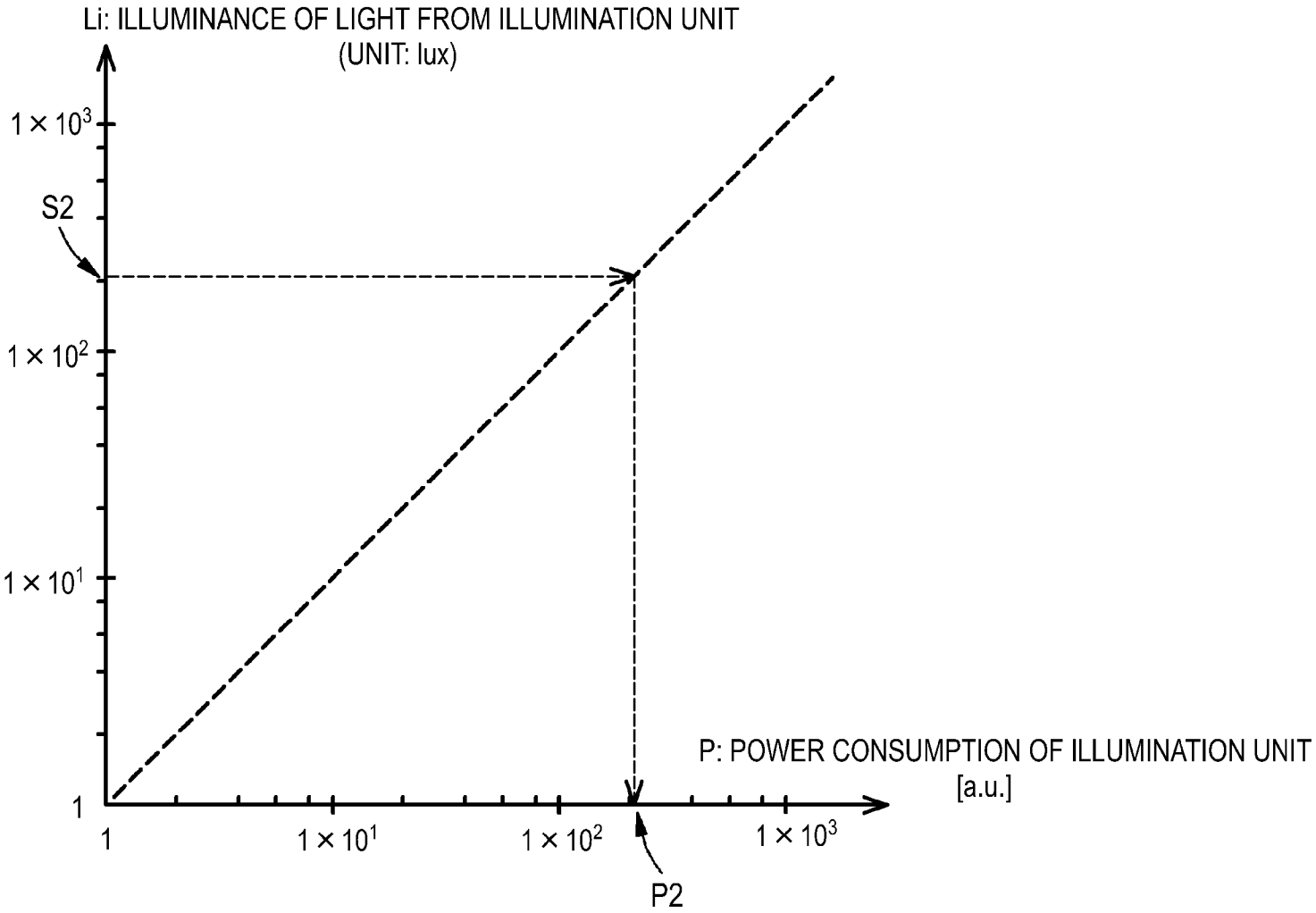
FIG. 5 is a graph schematically representing the relationship between the power consumption and the illuminance of an illumination unit.

FIG. 5 is a graph schematically representing the relationship between the power consumption of the illumination unit and the illuminance of the light from the illumination unit.

The light control circuit 32 receives the photosensor output S1, specifically a voltage signal according to the intensity of external light. In the light control circuit 32, a predetermined function $F_{ei}$ calculated beforehand based on the relationship between photosensor output S1 values and ambient illuminance values is stored in, for example, a table (not illustrated). The function $F_{ei}$ is a function that gives ambient illuminance values according to the photosensor output S1 values. The function $F_{Li}$ described in FIG. 3 is also stored in, for example, a table (not illustrated) in the light control circuit 32.

The light control circuit 32 calculates a function value $F_{ei}$(S1) based on the photosensor output S1, and, based on the result of this calculation, calculates a function value $F_{Li}(F_{ei}$(S1)). The function value $F_{Li}(F_{ei}$(S1)) is given as the illuminance value of the illumination light from the illumination unit 20. The light control circuit 32 then outputs the function value $F_{Li}(F_{ei}$(S1)) as the light control signal S2 to the light source driving circuit 23.

In FIG. 3, the horizontal axis represents the values of power consumption P of the illumination unit 20, and the vertical axis represents the illuminance Li values of the light from the illumination unit. Note that horizontal axis has an arbitrary unit.

As represented in FIG. 5, quantitatively, there is a linear relationship between the illuminance and power consumption of the illumination unit 20. The illumination unit 20 drives the light source 21 with power consumption P2 that corresponds to the value of the light control signal S2, and shines light toward the image display unit 10.

Note that the light control circuit 32 outputs a control signal (light control signal S2) that stops the emission of the light source 21 when the function value $F_{ei}$(S1) exceeds the predetermined second reference value $Ei_2$.

An image of a desired luminance according to the ambient illuminance can be displayed under the control described above.

It should be noted that the foregoing control is merely an example. Any control may be performed as long as it corresponds to the ambient illuminance. For example, the value of the light control signal S2 is not limited to the illuminance value of the illumination light described in FIG. 1.

Further, the illumination unit 20 described as including the light guide panel may be provided without the light guide panel. Such a variation is illustrated in FIG. 6.

Figure 6:
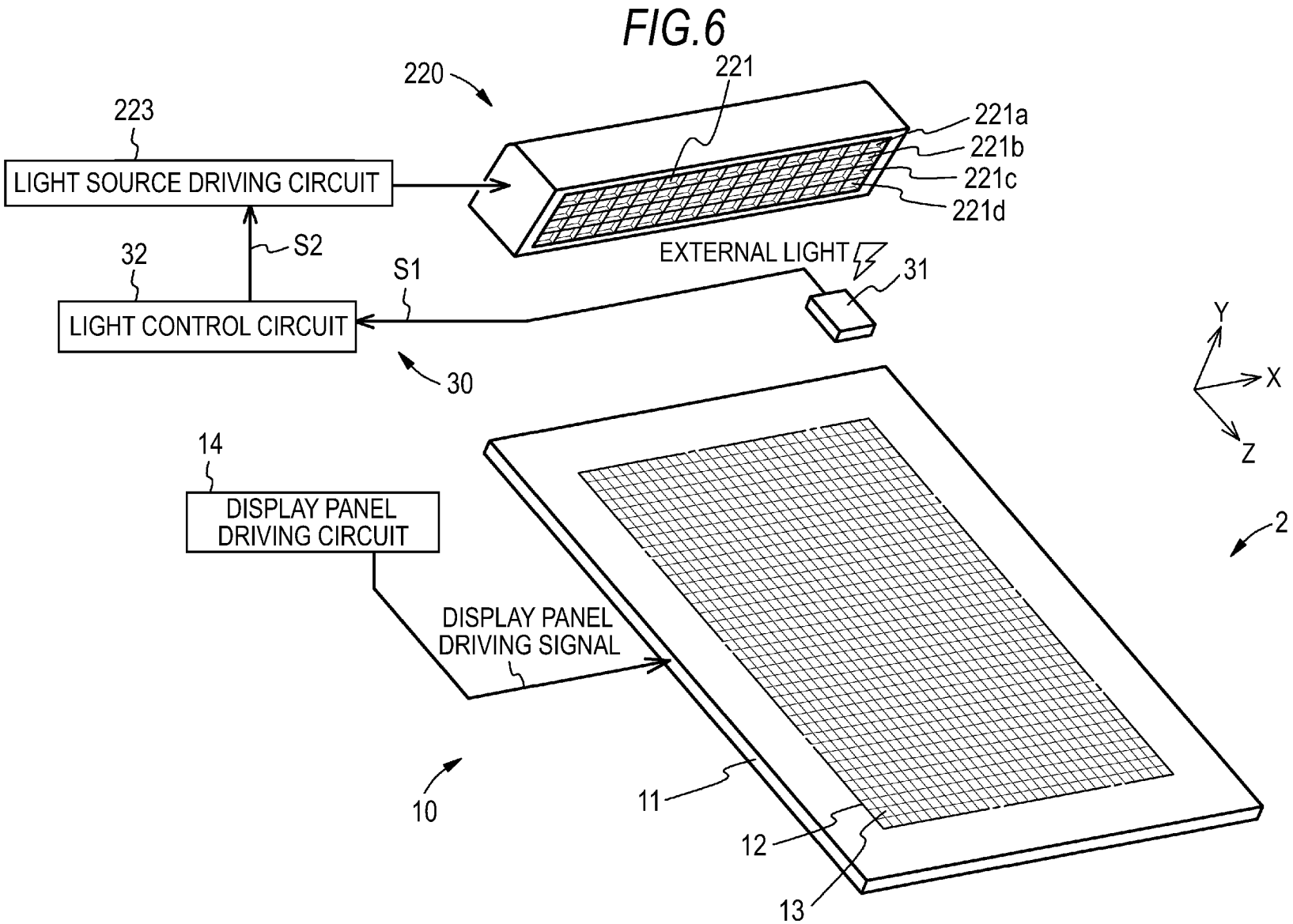
FIG. 6 is a perspective view schematically representing a variation of the display device of First Embodiment.

FIG. 6 is a perspective view schematically representing a variation of the display device of First Embodiment.

A display device 2 illustrated in FIG. 6 includes an illumination unit 220 that illuminates the image display unit 10 diagonally on the front. The illumination unit 220 includes a plurality of light sources 221. The light sources 221 are, for example, a collection of white LEDs, which are arranged in rows along the X axis direction. In the example illustrated in FIG. 6, the light sources 221 are disposed in four rows on a plane. The light sources in the first and second rows are represented by the reference numerals $\mathbf{221}_a$ and $\mathbf{221}_b$, respectively. Similarly, the light sources in the third and fourth rows are represented by the reference numerals $\mathbf{221}_c$ and $\mathbf{221}_d$, respectively.

The intensity distribution of the illumination light on the display region 12 is adjusted by controlling the emission of each light source 221. Qualitatively, the illumination light can have uniform intensity when the luminescence quantity satisfies the relation light source $\mathbf{221}_a$>light source $\mathbf{221}_b$>light source $\mathbf{221}_c$>light source $\mathbf{221}_d$. A light source driving circuit 223 differs from the light source driving circuit 23 of FIG. 1 in that the plurality of light sources is controlled.

Referring to the configuration of FIG. 1, the illumination unit and the light control unit may be regarded as a single unit. In this case, the illumination unit 20 represents an illumination unit that illuminates the reflective image display unit 10 having a display region provided with an array of pixels, and that includes a light control unit 30 provided to control the intensity of the illumination light on the display region of the image display unit 10 according to the ambient illuminance.

Figure 7:
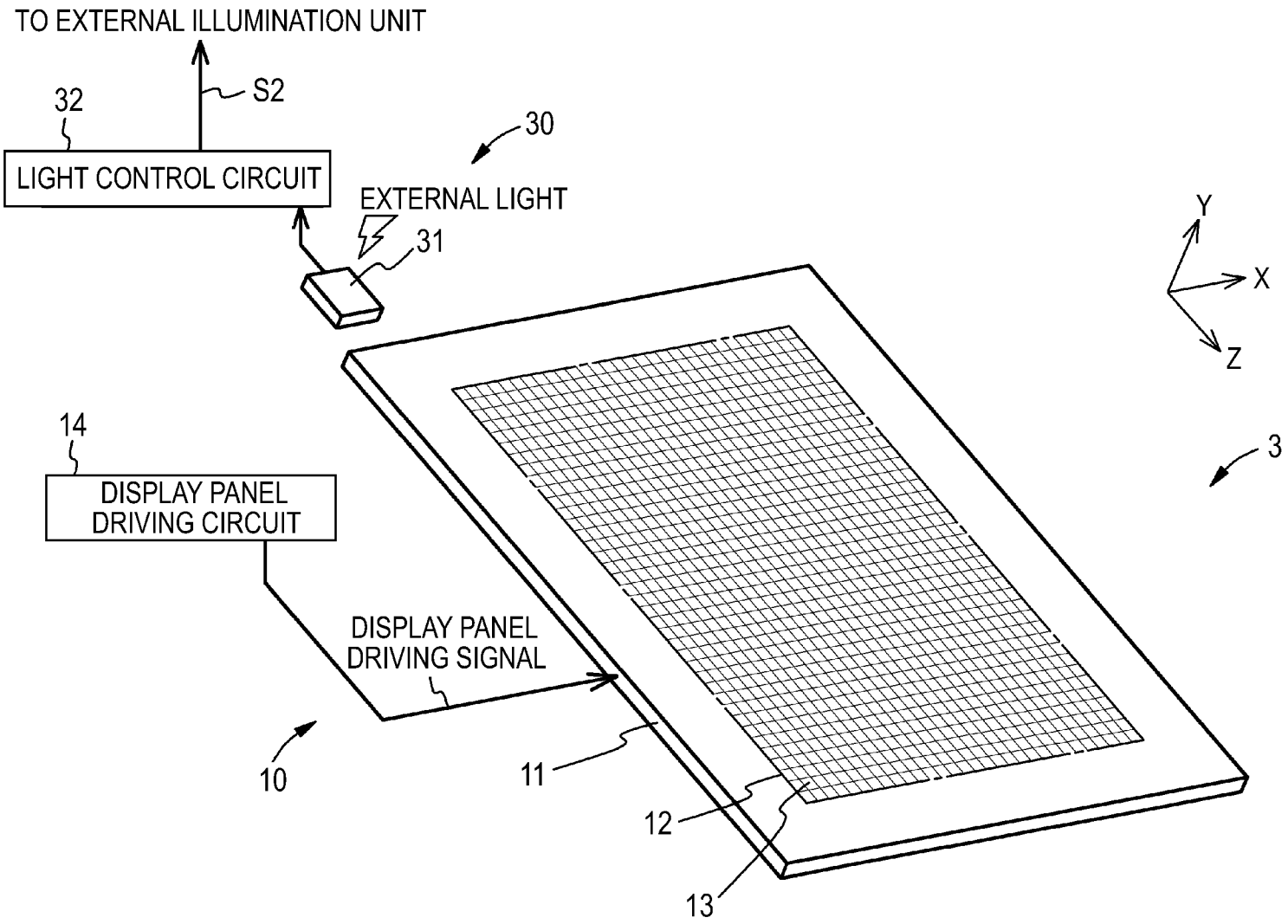
FIG. 7 is a perspective view schematically representing a variation of the display device of First Embodiment.

Alternatively, the image display unit and the light control unit may be regarded as a display device of a single unit. FIG. 7 represents a display device of such a configuration. A display device 3 includes a reflective image display unit 10 having a display region provided with an array of pixels, and a light control unit 30 by which the operation of the illumination unit that illuminates the display region of the image display unit 10 is controlled according to the ambient illuminance.

The present disclosure has been specifically described with respect to a certain embodiment. However, the present disclosure is not limited to the foregoing embodiment, and various modifications are possible based on the technical ideas of the present disclosure.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A display device comprising:

a reflective image display unit having a display region provided with an array of pixels;

an illumination unit that illuminates the display region of the image display unit; and a light control unit that controls the intensity of the illumination light from the illumination unit according to ambient illuminance, wherein the light control unit increases the intensity of the illumination light from the illumination unit with increase in ambient illuminance when the ambient illuminance is no greater than a predetermined first reference value, and wherein the light control unit decreases the intensity of the illumination light from the illumination unit with increase in ambient illuminance when the ambient illuminance is above the first reference value and no greater than a predetermined second reference value.

2. The display device according to claim 1, wherein the light control unit stops the illumination from the illumination unit when the ambient illuminance is above the second reference value.

3. An illumination unit that illuminates a reflective image display unit that has a display region provided with an array of pixels, the illumination unit comprising a light control unit that controls the intensity of the illumination light on the display region of the image display unit according to ambient illuminance, wherein the light control unit increases the intensity of the illumination light from the illumination unit with increase in ambient illuminance when the ambient illuminance is no greater than a predetermined first reference value, and wherein the light control unit decreases the intensity of the illumination light from the illumination unit with increase in ambient illuminance when the ambient illuminance is above the first reference value and no greater than a predetermined second reference value.

4. A display device comprising:

a reflective image display unit having a display region provided with an array of pixels; and a light control unit that controls the operation of an illumination unit that illuminates the display region of the image display unit, the light control unit controlling the operation of the illumination unit according to ambient illuminance, wherein the light control unit controls the operation of the illumination unit to increase the intensity of the illumination light from the illumination unit with increase in ambient illuminance when the ambient illuminance is no greater than a predetermined first reference value, and wherein the light control unit controls the operation of the illumination unit to decrease the intensity of the illumination light from the illumination unit with increase in ambient illuminance when the ambient illuminance is above the first reference value and no greater than a predetermined second reference value.

* * * * *